US007497223B2

(12) United States Patent
Blansit et al.

(10) Patent No.: US 7,497,223 B2
(45) Date of Patent: Mar. 3, 2009

(54) METHOD AND APPARATUS FOR SANITIZING A PRODUCT DISPENSER DRIP TRAY

(75) Inventors: Jeffrey A. Blansit, San Antonio, TX (US); John Vira, Lockhart, TX (US); Gabriel Dominguez, San Antonio, TX (US); Marion A. Mushinski, San Antonio, TX (US)

(73) Assignee: Lancer Partnership, Ltd., San Antonio, TX (US)

( * ) Notice: Subject to any disclaimer, the term of this patent is extended or adjusted under 35 U.S.C. 154(b) by 839 days.

(21) Appl. No.: 10/762,392

(22) Filed: Jan. 22, 2004

(65) Prior Publication Data

US 2005/0161065 A1 Jul. 28, 2005

(51) Int. Cl.
*B08B 3/04* (2006.01)

(52) U.S. Cl. ..... 134/115 R; 134/94.1; 134/100.1; 134/166 R; 134/169 R

(58) Field of Classification Search ..... 134/94.1, 134/100.1, 104.1, 115 R, 166 R, 167 R, 169 R, 134/186; 222/148, 345
See application file for complete search history.

(56) References Cited

U.S. PATENT DOCUMENTS 3,942,685 A * 3/1976 Lindner ..... 222/129.1
5,398,517 A * 3/1995 Poindexter ..... 62/125
6,568,565 B1 * 5/2003 Schroeder et al. ..... 222/105

* cited by examiner

*Primary Examiner*—Joseph L Perrin
(74) *Attorney, Agent, or Firm*—Christopher L. Makay

(57) ABSTRACT

A drip tray sanitizing system includes a pump connectable to a sanitizer solution container and a valve connectable to a diluent source. A spray manifold disposed in the drip tray receives a mixture of the two streams and sprays the mixture into the drip tray in a prescribed routine to produce a sanitizing or cleansing effect. Methods for using the drip tray sanitizing system include manual, semi-automatic, and automatic sanitizing, as well as manual and automatic rinsing. The semi-automatic and automatic sanitizing routines require the use of a controller. Use of this apparatus in a product dispenser may widen the range of products and product concentrates available for use with a product dispenser.

24 Claims, 8 Drawing Sheets

METHOD AND APPARATUS FOR SANITIZING A PRODUCT DISPENSER DRIP TRAY

BACKGROUND OF THE INVENTION

1. Field of the Invention

The present invention relates to product dispensers, and more particularly to, but not by way of limitation, to a method and apparatus for sanitizing or cleansing a drip tray of a product dispenser.

2. Description of the Related Art

Product dispensers on the market typically are sold with a drip tray and a cup rest attached. The drip tray serves as a safeguard to catch and control overspray and overfill of product. The drip tray also ends up as a disposal site for unwanted drinks, unwanted ice and in cases where the dispenser is not producing the product in the right proportions, bad dispenses.

Two types of drip trays exist, draining and non-draining. Draining drip trays are typically hard-plumbed to the drain lines of a building. The non-draining drip trays are not plumbed and must be emptied on a regular basis, or immediately when full. For this reason, drip trays on product dispensers with shelf stable products are usually installed with a hard mounted drain. The installed drain enables the users to dispose of items through a hard-plumbed, permanent sewer disposal system, thereby avoiding the mess associated with overflowing of the non-draining drip tray.

In some cases, where it would be unpleasant for the product or product concentrate spills to sit in the drip tray for extended periods, the drip trays are removable, thereby forcing the operators to clean the drip trays daily. Problems with this situation arise when operators do not clean the drip trays on a regular basis. For example, uncleaned drip trays in citrus dispensers can attract fruit flies, as well as cause unpleasant odors or bacterial growth.

Still another level of cleanliness is required for products that belong to the dairy family. Milk or milk concentrate will spoil quickly if a remnant is left exposed in a drip tray or even a drain. Spoiled milk or dairy products around a dispenser can cause foul odors, be unsightly, and promote bacterial growth. Milk dispensers on the market typically do not have more than a catch basin, if they have any sort of drip tray at all. Accordingly, a sanitizing system for a drip tray would be both beneficial and effective in promoting a cleaner product dispenser and surrounding environment.

SUMMARY OF THE INVENTION

The present invention is a sanitizing system for a product dispenser similar in type, but not exclusive to the product dispenser disclosed in U.S. Pat. No. 6,568,565, which issued on May 27, 2003. In this filing, a drip tray sanitizing system includes a valve, a pump and a spray manifold used to deliver a sanitizing mixture or a diluent to a drip tray of a product dispenser. The sanitizing mixture or diluent is sprayed in a shape complementary to the inner chamber of the drip tray for a predetermined interval. The drip tray sanitizing system may further include a controller to conduct the cleansing or rinsing routines automatically or semi-automatically. The drip tray sanitizing system may be implemented in new production or may be retrofit into existing product dispensers.

A method of sanitizing the drip tray includes pumping sanitizing solution from a package, mixing the dispensed sanitizing solution with diluent, and dispensing the mixed solution through a spraying apparatus into the drip tray in a prescribed pattern to produce a cleansing or sanitizing effect.

A second method includes using the drip tray sanitizing system to rinse the drip tray. In this case, sanitizer is not delivered to the drip tray. Further derivations of the methods include sanitizing the drip tray and/or rinsing automatically through the use of the controller and a software activation routine. With this type of control scheme, the sanitizing and the rinsing may be activated in a timed fashion to optimize the cleansing effect.

It is therefore an object of the present invention to provide a system for delivering a sanitizing mixture or a diluent into a drip tray to produce a cleansing or sanitizing effect.

It is further an object of the present invention to provide a drip tray sanitizing system that automatically conducts a sanitizing or rinsing routine through the use of a real time clock.

It is still further an object of the present invention to provide a beverage dispenser with a drip tray sanitizing system.

Still other objects, features, and advantages of the present invention will become evident to those of ordinary skill in the art in light of the following. Also, it should be understood that the scope of this invention is intended to be broad, and any combination of any subset of the features, elements, or steps described herein is part of the intended scope of the invention.

BRIEF DESCRIPTION OF THE DRAWINGS

FIG. 3*a* is a block diagram of a control system associated with a method of manually sanitizing a drip tray.

DETAILED DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. It is further to be understood that the figures are not necessarily to scale, and some features may be exaggerated to show details of particular components or steps.

A method and apparatus are used to sanitize a product dispenser drip tray. The apparatus includes a spray manifold disposed in the drip tray of a product dispenser. The present invention is a sanitizing system for a product dispenser similar in type, but not exclusive to the product dispenser disclosed in U.S. Pat. No. 6,568,565, which issued on May 27, 2003. In this filing, a sanitizing system includes a drip tray with a drain, a cup rest, a spray manifold, a pump that draws sanitizer fluid from a sanitizer solution container, a water valve, a backflow prevention device, and, if desired, a control system that activates and deactivates the system in a prescribed routine to produce a cleansing or sanitizing effect in the drip tray. A method of sanitizing the drip tray includes pumping a sanitizing solution from a package, mixing the dispensed sanitizing solution with a diluent, and dispensing the mixed solution through a spraying apparatus into the drip tray.

Figure 1:
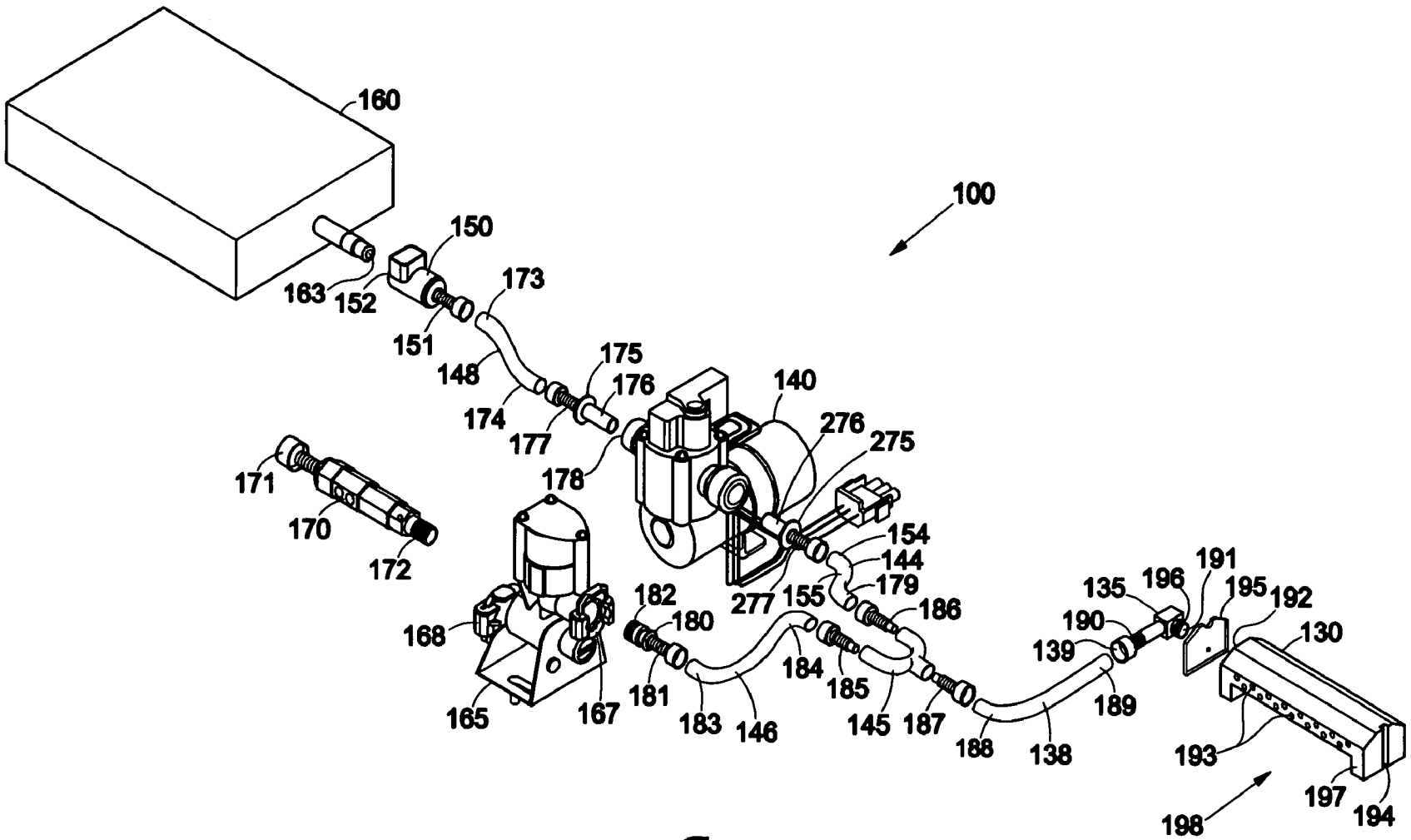
FIG. 1 is an exploded view illustrating the components of a sanitizing system according to the preferred embodiment.

As illustrated in FIGS. 1-3, a drip tray sanitizing system 100 includes a spray manifold 130, a pump 140, a sanitizer container 160, and a valve 165. The pump 140 includes an inlet port 178 and an outlet port 179. The inlet port 178 is coupled to a tubing adapter 175 having a first end 176 and a second end 177. The first end 176 includes a smooth outer face to mate with an o-ring (not shown), thereby creating a sealed passage. The second end 177 is a barb fitting, commonly used in the industry, for mating with flexible tubing. The second end 177 of the tubing adapter 175 is connected to a first end 174 of a flexible tubing, herein known as a first sanitizer supply line 148. A second end 173 of the first sanitizer supply line 148 adapts to an outlet port 151 of a quick disconnect connector 150. The inlet port 152 of the quick disconnect connector 150 is suitable for mating with an outlet port 163 of the sanitizer container 160. While this quick disconnect connector 150 has been shown with o-rings, one skilled in the art will recognize that any suitable type of quick disconnect may be used to accelerate changeout of the container 160.

The outlet port 179 of the pump 140 is connectable to a first end 276 of a second adapter 275. A second end 277 of the second adapter 275 is connectable to an inlet port 154 of a second sanitizer supply line 144. An outlet port 155 of the second sanitizer supply line 144 is connectable to a second inlet port 186 of a mixing union 145.

The valve 165 is a solenoid-operated valve, and includes an inlet port 168 and an outlet port 167. The inlet port 168 of the valve 165 attaches to an outlet port 172 of a backflow prevention device 170 or may attach to a diluent supply tube, depending upon installation constraints. The backflow prevention device 170 further includes an inlet port 171 that is plumbed to a diluent source. The backflow prevention device 170 separates the fluid system from a public water system. As such, the diluent may flow from the inlet port 171 to the outlet port 172 of the backflow prevention device 170, but cannot flow in the reverse direction to the supply.

The outlet port 167 of the valve 165 is adapted to mate with a first end 182 of a tubing adapter 180. The tubing adapter 180 includes a second end 181 having a barb fitting for coupling with flexible tubing. The second end 181 of the adapter 180 connects to a first end 183 of a diluent supply tube 146. The diluent supply tube 146 further includes a second end 184 that is adaptable to a first inlet port 185 of the mixing union 145. The mixing union 145 further includes an outlet port 187.

The outlet port 187 of the mixing union 145 is coupled to an inlet port 188 of a mixture tube 138. An outlet port 189 of the mixture tubing 138 is coupled to an inlet port 190 of a removable fitting 135. The removable fitting 135 includes an outlet port 191 suitable for mating with an inlet port 192 of the spray manifold 130. In this preferred embodiment, the structure includes o-rings, a bore, and a lockplate 195 to secure the removable fitting 135 to the spray manifold block 130 and maintain a seal. While this preferred embodiment has been shown with o-rings, any suitable means may be used to provide the ability to remove and reinstall the fitting 135 in the spray manifold 130.

The spray manifold 130 includes the inlet port 192, an inner passage 196, spray ports 193, and a groove 194. The inner passage 196 is contained within the confines of the spray manifold 130, and can be accessed through the inlet port 192. The spray ports 193, located in a predetermined pattern on a first side 197 and a second side 198 of the spray manifold 130, pass through to the inner passage 196, thereby providing multiple exit ports for fluids entering through the inlet port 192. It should be understood by those of ordinary skill in the art that the spray ports 193 may be located on the spray manifold 130 on only one side and in any pattern. The alignment groove 194 is located parallel to the first and second sides 197 and 198 of the spray manifold 130 to provide alignment aid upon installation.

The mixing union 145 allows the sanitizing fluid and the diluent streams to merge before entering the spray manifold 130. Although this preferred embodiment includes the mixing union 145, mixing may be accomplished through other means or in varying components. Illustratively, the sanitizing fluid stream and the diluent stream may each be input separately into the spray manifold 130 or the fluid paths may be joined through a standard tee connection.

Figure 2A:
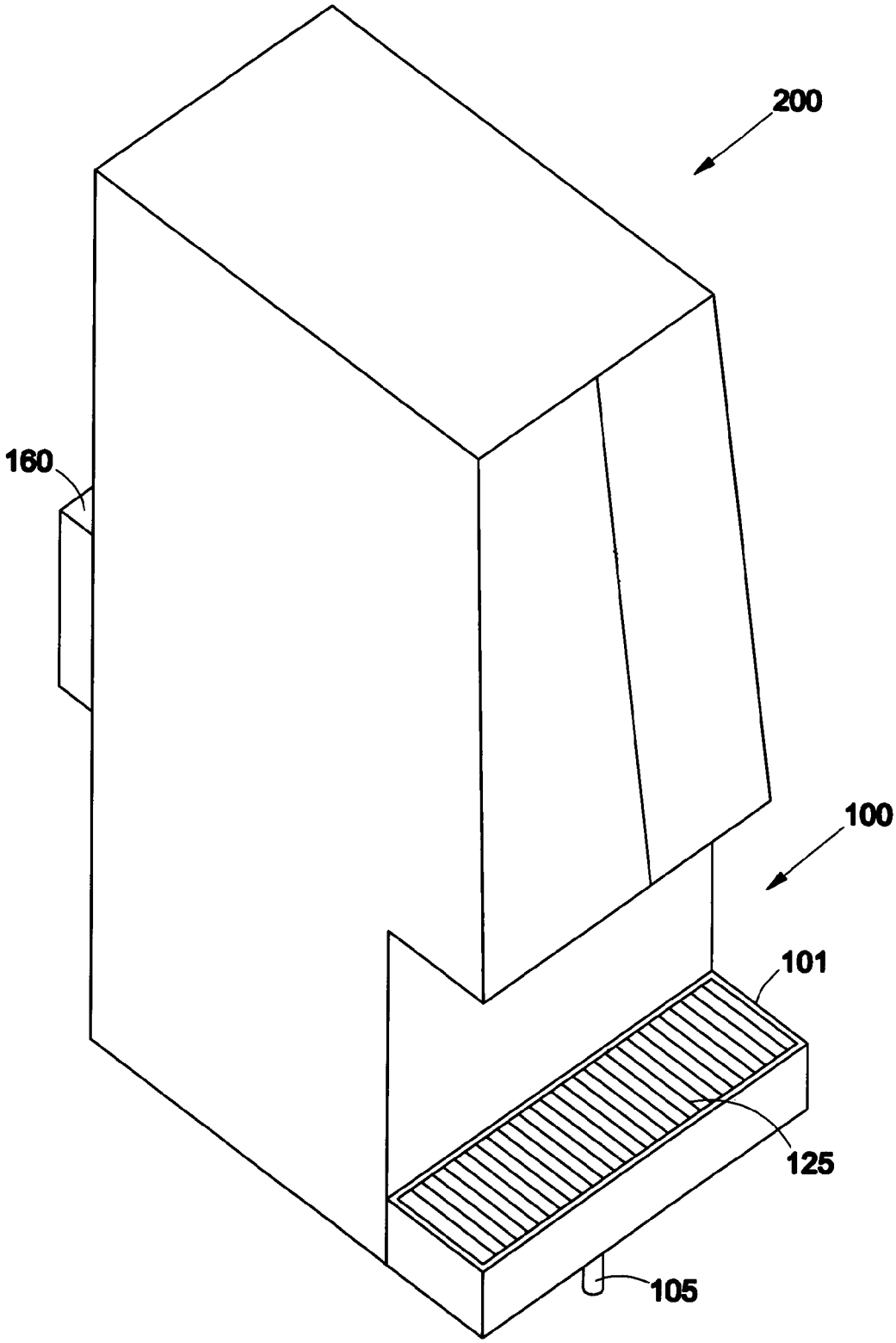
FIG. 2*a* is a perspective view of a product dispenser with a self-sanitizing drip tray.

As shown in FIG. 2*a*, a product dispenser 200 includes a drip tray 101 with a drain 105, and a cup rest 125. The drip tray 101 is typically removable for cleaning. The cup rest 125 fits into the drip tray 101, thereby providing a level surface for cups to rest on while being filled. The drain 105, when connected to a suitable sewage disposal system, allows for easy disposal of drip tray food contents and cleansing fluids.

Figure 2B:
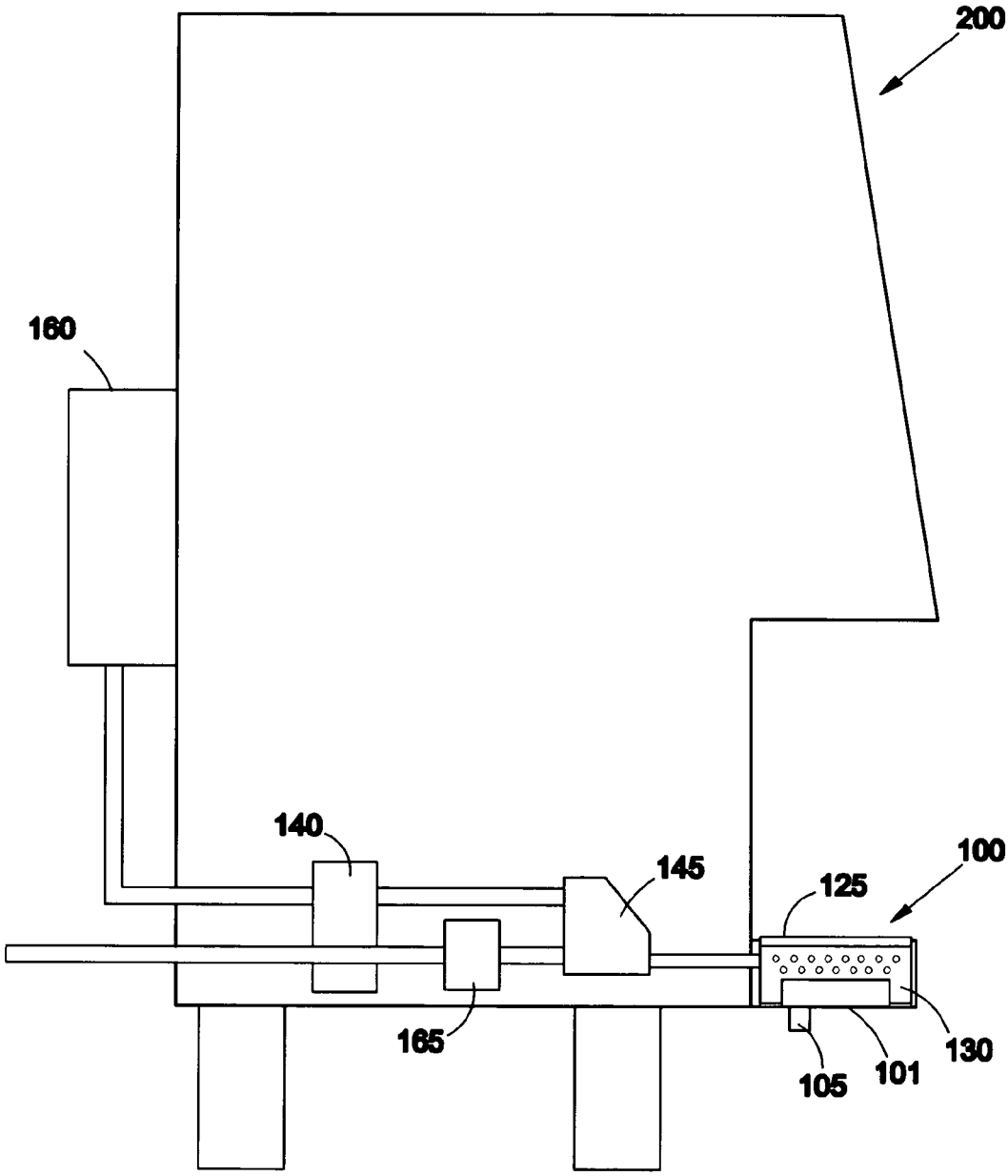
FIG. 2*b* is a side view and a cut away of a product dispenser with a self-sanitizing drip tray.

As shown in FIG. 2*b*, the product dispenser 200 may be outfitted with a drip tray sanitizing system 100. The drip tray sanitizing system 100 may be retrofit into existing product dispensers or may be installed as a new production feature. In use, the spray manifold 130 must be disposed inside of the drip tray 101, beneath the cuprest 125 to refrain from impacting a user interface area. The remainder of the components, including the mixing union 145, the valve 165, and the pump 140 may be located remotely from the spray manifold 130, as required, depending upon dispenser design constraints and installation conditions.

Optimally, the sanitizing system lines would be located within the confines of the product dispenser 200, with an access port providing an entrance for the diluent source line and the sanitizer line 148. The sanitizer container 160 may be located remote from the pump 140. The sanitizer container 160 should be located in an easily accessible location to facilitate the changing of the container 160. Illustratively, the sanitizer container 160 could be stored in a hanging position on a backside of the dispenser 200, underneath the product dispenser 200, or beneath a countertop. The container 160 in this preferred embodiment is a disposable container for ease of use. However, one skilled in the art will recognize that the container may be of the refillable type to reduce sanitizer packaging costs.

The drip tray sanitizing system 100 may further include a pump switch 141 and a valve switch 166 as shown in FIG. 3*a* for activation by an operator. Power is supplied from the power supply 161 to the pump 140 and the valve 165 when the switches 141 and 166 are depressed. The switches 141 and 166 may be activated manually by an operator to provide power to the pump 140 and the valve 165.

In operation, when the pump 140 is powered, the sanitizing fluid located in the sanitizer container 160 is suctioned out of the container outlet 163, through the quick disconnect connector 150, through the sanitizer supply tube 148, through the adapter 175 to the inlet port 178 of the pump 140. The sanitizer fluid passes through the pump 140 and exits the pump outlet 179. Once out of the pump 140, the sanitizer fluid is forced through the second adapter 275, and then through the high pressure sanitizer line 144 to the second inlet port 186 of the mixing union 145.

The diluent from the diluent source enters the sanitizing drip tray control system through the inlet port 171 of the backflow prevention device. Pressure from the diluent source forces the diluent through the backflow prevention device 170, and into the inlet 168 of the valve 165. The diluent flow stops at the valve 165 when the valve 165 is in a closed position. When powered, the valve 165 is in an open position, and the diluent flows therethrough. Once the diluent exits the outlet port 167 of the valve, it flows through the adapter 180, and through the diluent tube 146, thereby entering the first inlet port 185 of the mixing union 145.

The sanitizer fluid and the diluent streams merge in the mixing union 145 and exit the outlet port 187. The mixture then moves through the mixture tube 138, through the removable fitting 135, and into the inlet 192 of the spray manifold 130 when the pump 140 is on and the valve 165 is in the open position. The mixture continues past the inlet port 192 and enters the inner passage 196, where it is forced to exit through the plurality of smaller diameter outlet ports 193. The smaller diameter outlet ports 193 force the fluid to exit in a jet stream, thereby creating a predetermined spray pattern complementary to the inner envelope of the drip tray 101. The mixture is sprayed into the drip tray 101 until the pump 140 and the valve 165 are de-energized. Excess fluid will drain out of the drip tray 101 through the drain port 105 to a suitable disposal.

Figure 3B:
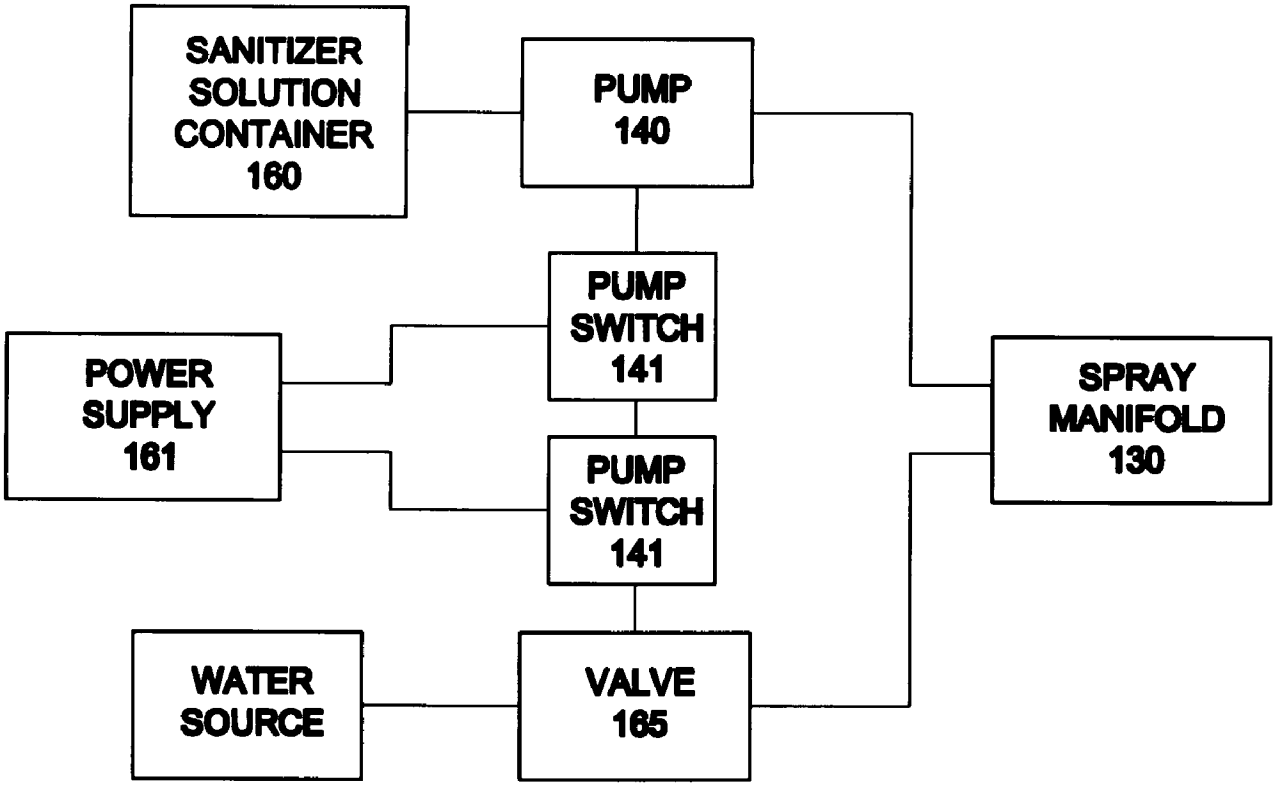
FIG. 3*b* is a method flowchart for a manual sanitize routine.
Figure 3B:
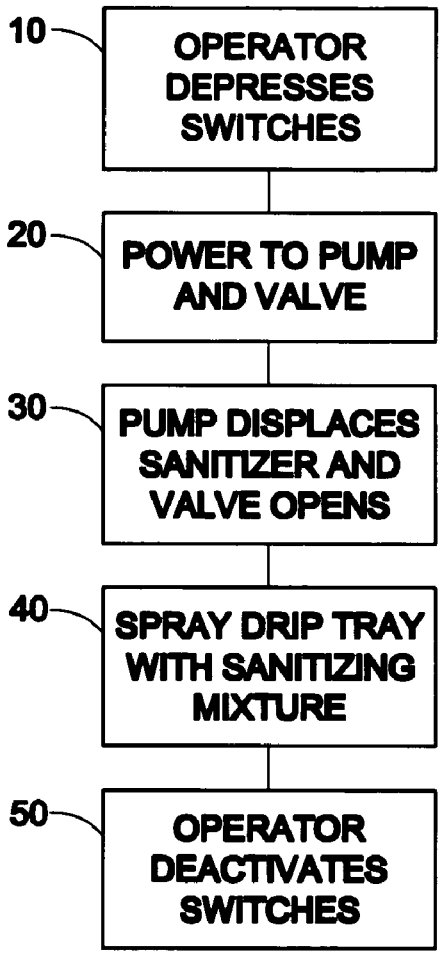

FIG. 3*b* provides a method flowchart for manually conducting a drip tray sanitizing operation in a product dispenser 200. The process commences with step 10, wherein an operator activates the pump switch 141 and the valve switch 166 to provide power to the pump 140 and the valve 165, respectively, step 15. The process continues with step 20, wherein the pump 140 displaces the sanitizer fluid and the valve 165 opens to allow the diluent to flow past the valve 165. Both the sanitizer fluid and the diluent flow to the spray manifold 130 and are sprayed into the drip tray 101, step 25. The mixture continues to flow until the switches are deactivated in step 30.

While the manual process has been shown with both the valve switch 166 and the pump switch 141 being activated, one skilled in the art will recognize that only one switch may be activated to allow for either a sanitizing fluid only or a diluent only flow. The use of a sanitizing fluid only flow would be beneficial in providing a higher concentration of sanitizing fluid in the drip tray 101. The use of a diluent only flow is beneficial to provide a rinsing function in the drip tray 101, thereby decreasing amount of sanitizing fluid used in a given time interval. As such, the operator may alternate between rinsing and sanitizing the drip tray 101 on a personal preference basis.

Figure 3C:
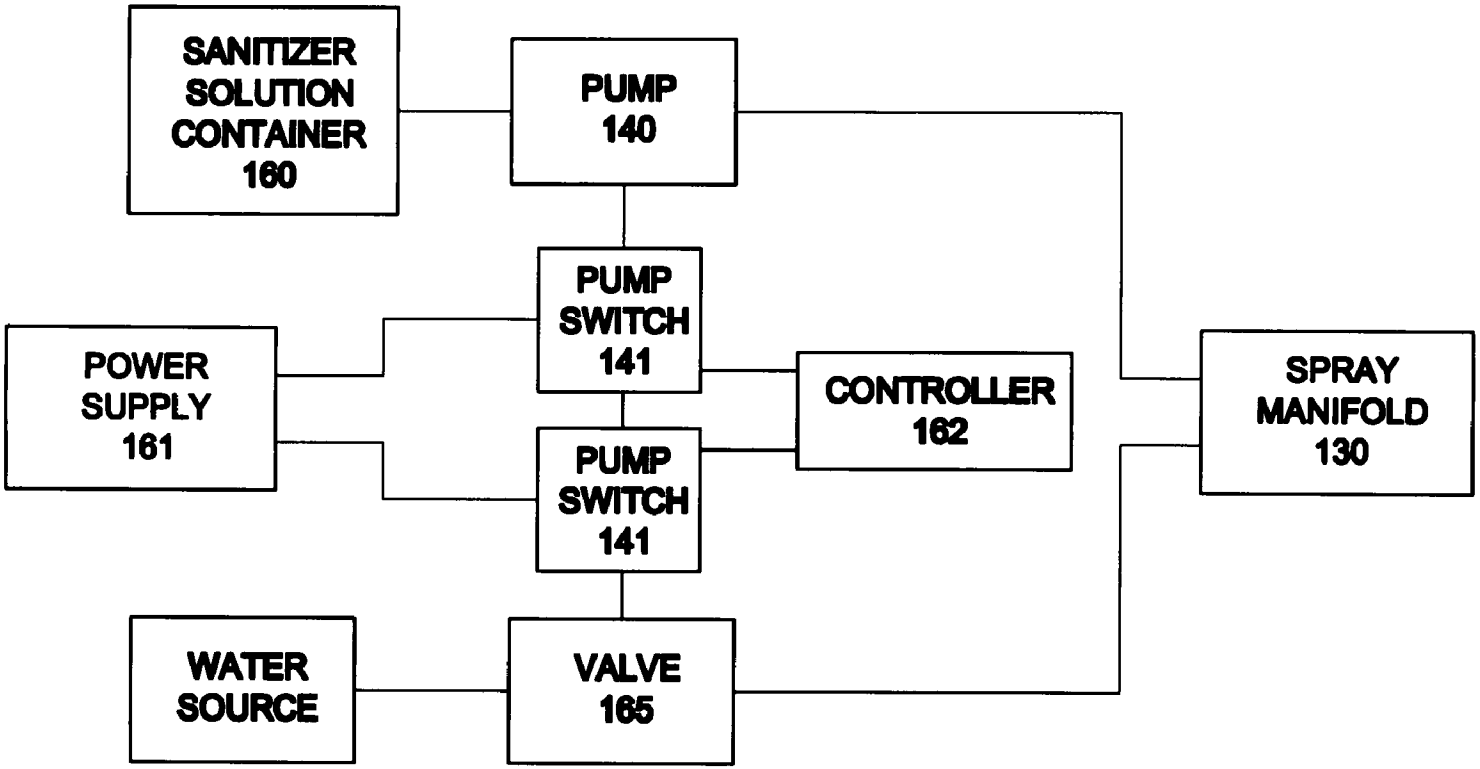
FIG. 3*c* is a block diagram of a control system associated with a semi-automatic or automatic sanitizing system for a drip tray.

Alternatively, a controller 162, which may be any suitable control device such as a microprocessor or microcontroller, may be employed to provide the switching as shown in FIG. 3*c*. The use of a controller 162 provides the capability to semi-automatically or automatically conduct all or some of the drip tray sanitizing operations. The controller 162, the power supply 161, and the switches 141 and 166 may be packaged as a standalone control system for the drip tray sanitizing system 100 or may be fully integrated into an existing electronic control system of the product dispenser 200.

Figure 3D:
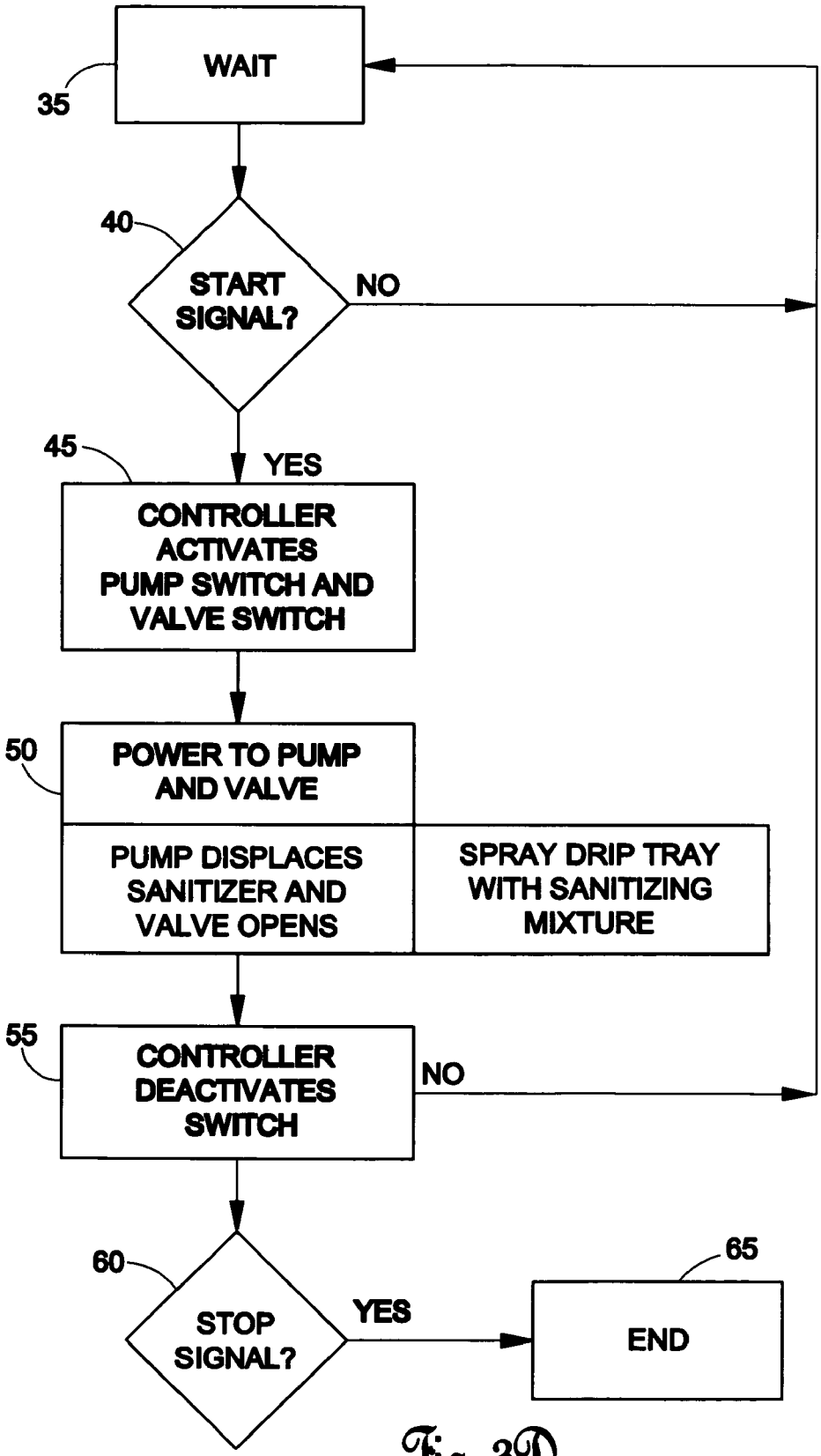
FIG. 3*d* is a method flowchart for semi-automatically sanitizing a product dispenser drip tray.

FIG. 3*d* provides a method flowchart for semi-automatically sanitizing a drip tray 101. In this embodiment, the process is still initiated by an operator, but the remainder of the process is conducted by the controller 162. The process begins with step 35, wherein the controller 162 is in a wait state. The controller 162 then moves to step 40, wherein it determines whether a start signal has been received by the operator. If a start signal has not been received, the process returns to the wait state in step 35. If a start signal has been received in step 40, then the process moves to step 45, wherein the controller 162 activates the pump switch 141 and the valve switch 166. Once activated, power is transferred to the pump 140 and the valve 165.

The pump 140 siphons the sanitizer fluid from the sanitizer container and the valve 165 moves to an open position, thereby allowing the sanitizing fluid stream and the diluent stream to move towards the mixing union 145. The diluent stream and the sanitizing fluid stream merge in the mixing union 145, and are allowed to mix. The controller 162 continues to energize the switches 141 and 166 for a predetermined interval, thereby allowing the sanitizing mixture to move through the spray manifold 130, and into the drip tray 101. At the end of the predetermined interval, ten seconds in this preferred embodiment, the controller 162 deactivates the switches 141 and 166 to stop the flow of the sanitizing fluid, the diluent, and ultimately, the sanitizing mixture, step 55. Next, the controller 162 determines if a stop signal has been received, step 60. If a stop signal has been received the process moves to step 65, the end. If a stop signal has not been received in step 60, the controller 162 returns to step 35 to await another start signal. The sanitizing mixture pools in the drip tray 101 to provide a sanitizing effect, and then moves down the drain, thereby sanitizing the drain line.

Similar to the manual process previously disclosed, the semi-automatic process may further include a rinse only function. The semi-automatic rinse process is virtually identical to the method of FIG. 3*d*, except that the controller 162 activates and deactivates only the valve switch 166 in steps 45 to step 55. The ability to only use the diluent provides additional cost savings through reduced sanitizer fluid or sanitizer fluid concentrate. In this arrangement, the operator has the ability to determine the level of cleansing required.

Figure 3E:
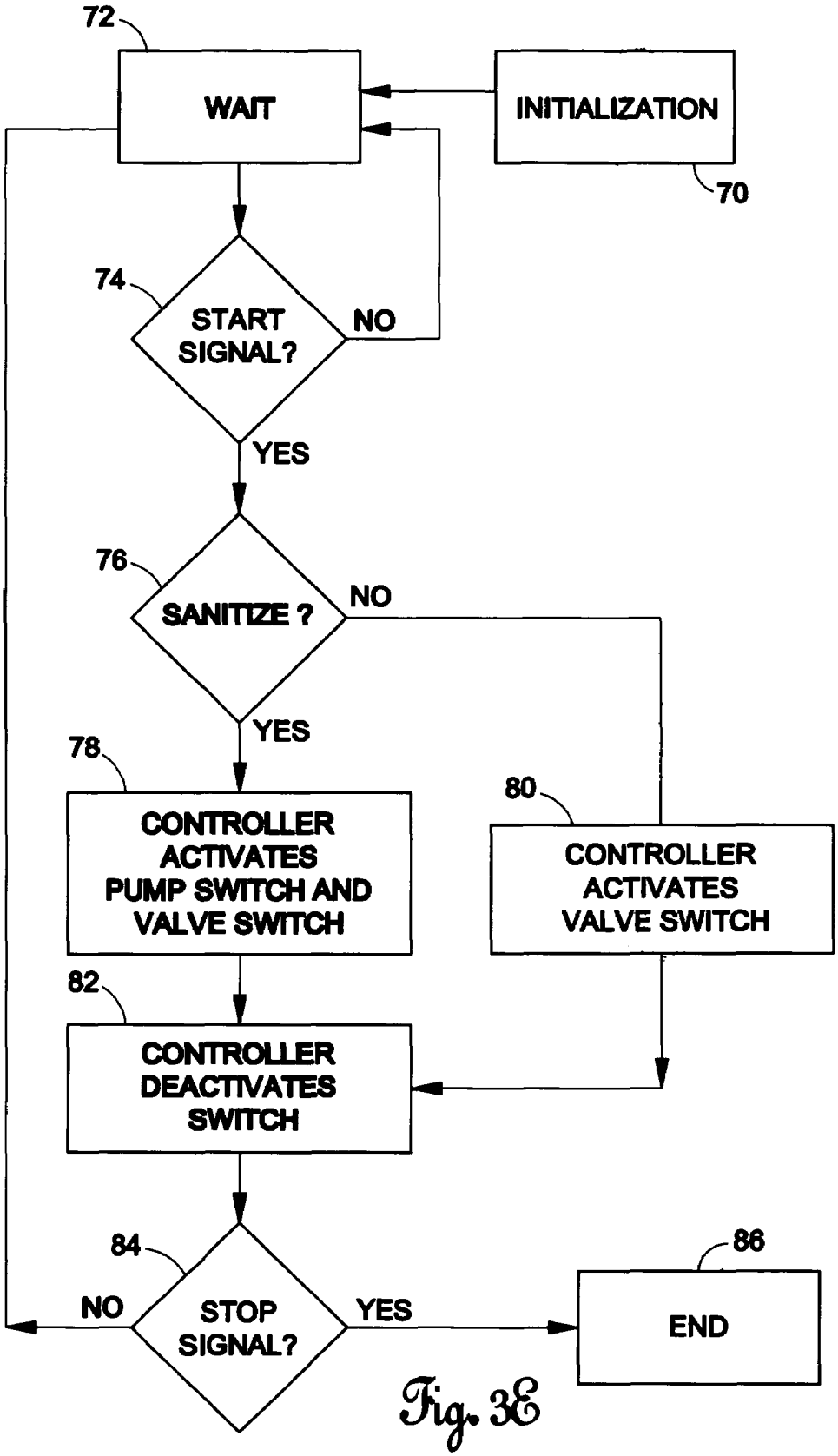
FIG. 3*e* is a method flowchart for automatically sanitizing a product dispenser drip tray.

In a fully automatic embodiment, the controller 162, having a real-time clock, conducts all of the sanitizing operations for the product dispenser 200. The method flowchart of FIG. 3*e* illustrates the fully automatic process. In the fully automatic process, the controller 162 activates and deactivates the valve switch 141 and the pump switch 166 at predetermined intervals from initialization of the product dispenser 200 to control the flow of fluids to the spray manifold 130 and drip tray 101. In this arrangement, the controller 162 may be programmed to conduct a cleansing routine on a scheduled basis, illustratively, every fifteen minutes or on the hour. Further advantages of this type of arrangement include the ability to alternate between the sanitizing routine and the rinsing routines to minimize the unnecessary use of sanitizing fluid. The length of the cleansing routine may also be customized to tailor the sequence to a specific product type.

The process begins with step 70, wherein the product dispenser 200 and the controller 162 are initialized. The controller 162 proceeds to a wait state, as shown in step 72. The controller 162 then moves to step 74, wherein the controller 162 determines whether a start signal has been received. If a start signal has not been received, the process returns to step 72, the wait state. If a start signal has been received, the controller 162 moves to step 76, wherein the controller 162 determines if the start signal is for a sanitize routine or a rinse routine. If the start signal is for a sanitize routine, the process moves to step 78, wherein the controller 162 activates the valve switch 166 and the pump switch 141, thereby allowing the sanitizer fluid and the diluent to flow to the spray manifold 130.

The valve switch 166 and the pump switch 141 are activated for a predetermined interval, ten seconds in this preferred embodiment, to allow the mixture to spray the inside of the drip tray 101. After the predetermined interval, the controller 162 moves to step 82, wherein it deactivates the switches 141 and 166 to cease the flow of fluids to the drip tray 101. If the start signal in step 76 was not for a sanitize routine, then the process moves to step 80, wherein the controller 162 activates only the valve switch 166 for the predetermined interval, thereby commencing a rinse routine. Upon ending the activation time, the process moves to step 82, wherein the controller 162 deactivates the switches to cease the flow of fluids to drip tray 101. In step 84, the controller 162 determines if a stop signal has been received. If a stop signal has been received, the process moves to step 86, where the process ends. If a stop signal has not been received, the process returns to step 72, the wait state, such that the controller 162 may continue to monitor for start signals.

The fully automatic process has been shown to accommodate a rinse cycle to minimize the use of the sanitizer fluid or fluid concentrate. It should be clear to one skilled in the art the controller 162 has control of the valve switch 166 and the pump switch 141 to conduct any rinsing or sanitizing functions. It should also be clear that a set of manual override switches may be included for use in an on demand type if arrangement, thereby allowing the operator to conduct an unscheduled cleansing operation.

While this process has been shown to hinge on the initialization of the product dispenser 200, it should be clear to one skilled in the art that the controller 162 may use an actual time as an activation point for the commencement of the a sanitizing routine; illustratively, on the hour, store closing time, store opening time, etc., to remove the possibility of missed cleansing cycles.

Although the present invention has been described in terms of the foregoing preferred embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing detailed description; rather, it is defined only by the claims that follow.

We claim:

1. A drip tray sanitizing system, comprising:

a pump having an inlet port and an outlet port, wherein the inlet port is in communication with a sanitizing fluid source; and a spray manifold disposed in a drip tray of a product dispenser, the spray manifold having an inlet port in communication with the outlet ports of the pump and multiple exit ports, wherein, when energized, the pump delivers a sanitizing fluid through the outlet ports of the spray manifold and into the drip tray for cleansing or sanitizing purposes.

2. The drip tray sanitizing system according to claim 1, further comprising:

a controller in electrical communication with the pump, wherein the controller controls the activation of the pump, thereby controlling the delivery of the sanitizing fluid through the spray manifold and into the drip tray.

3. The drip tray sanitizing system according to claim 1, further comprising:

a valve including an inlet port and an outlet port, wherein the inlet port is communication with a diluent source, and the outlet port is in fluid communication with the spray manifold, wherein when energized, the valve delivers a diluent to the spray manifold for delivery to the drip tray for mixing with the sanitizing fluid.

4. The drip tray sanitizing system according to claim 3, further comprising:

a controller in electrical communication with the pump and the valve, wherein the controller controls the activation of the pump and the valve, thereby controlling the delivery of the sanitizing fluid and the diluent through the spray manifold and into the drip tray.

5. The drip tray sanitizing system according to claim 4, wherein only the valve is energized to provide a rinsing function.

6. The drip tray sanitizing system according to claim 3, further comprising:

a mixing union coupled at a first inlet to the outlet of the pump, at a second inlet to the outlet of the valve, and at an outlet to the inlet port of the spray manifold, whereby the diluent and the sanitizing fluid merge before entry into the spray manifold to aid in mixing.

7. The drip tray sanitizing system according to claim 1, wherein the sanitizing fluid source is a container filled with a sanitizing fluid.

8. The drip tray sanitizing system according to claim 7, wherein the container is disposable.

9. The drip tray sanitizing system according to claim 7, wherein the container is refillable.

10. The drip tray sanitizing system according to claim 7, wherein the container is coupled to the drip tray sanitizing system with a quick disconnect connector to ease container change out.

11. The drip tray sanitizing system according to claim 1, further comprising:

a pump switch in electrical communication with the controller and the pump, wherein the pump is energized when the pump switch is depressed, thereby delivering sanitizing fluid to drip tray.

12. The drip tray sanitizing system in claim 3, further comprising:

a valve switch in electrical communication with the controller and the valve, wherein the valve is energized when the valve switch is depressed, thereby delivering diluent to the drip tray.

13. The drip tray sanitizing system according to claim 4, wherein the controller energizes only the valve to rinse the drip tray.

14. The drip tray sanitizing system according to claim 2, wherein the controller energizes only the pump to move sanitizing fluid into the drip tray.

15. A product dispenser, comprising:

a housing, wherein the housing includes a controller;

a drip tray disposed on the housing; and a drip tray sanitizing system, wherein a spray manifold, disposed in the drip tray, is coupled to a pump in communication with a sanitizing fluid source to deliver a sanitizing fluid to the drip tray for cleansing or sanitizing purposes when the sanitizing system is energized.

16. The product dispenser according to claim 15, further comprising:

a controller in electrical communication with the pump, wherein the controller controls the activation of the pump, thereby controlling the delivery of the sanitizing fluid through the spray manifold and into the drip tray.

17. The product dispenser according to claim 15, further comprising:

a valve including an inlet port and an outlet port, wherein the inlet port is communication with a diluent source, and the outlet port is in fluid communication with the spray manifold, wherein when energized, the valve delivers a diluent to the spray manifold for delivery to the drip tray for mixing with the sanitizing fluid and cleansing purposes.

18. The product dispenser according to claim 17, further comprising:

a controller in communication with the valve and the pump, wherein the controller energizes the valve and the pump to deliver the mixture of the sanitizing fluid and the diluent to the drip tray.

19. The beverage dispenser according to claim 15, wherein the drip tray sanitizing system is internal to the beverage dispenser.

20. The beverage dispenser according to claim 15, wherein the drip tray sanitizing system is a retrofit into existing product dispenser.

21. The product dispenser according to claim 17, wherein the valve and the pump of the drip tray sanitizing system are remotely located from the product dispenser.

22. The product dispenser according to claim 18, wherein the controller energizes only the valve to provide a drip tray rinse function.

23. The product dispenser according to claim 16, wherein the controller energizes only the pump to move sanitizing fluid to the drip tray.

24. The product dispenser according to claim 18, wherein the controller initiates drip tray sanitizing cleansing routines at predetermined intervals.

* * * * *